US006550109B2

(12) United States Patent
Sims

(10) Patent No.: US 6,550,109 B2
(45) Date of Patent: Apr. 22, 2003

(54) BUTTON LATCH

(76) Inventor: James O. Sims, 908 Brooks St., SE., Decatur, AL (US) 35602

( * ) Notice: Subject to any disclaimer, the term of this patent is extended or adjusted under 35 U.S.C. 154(b) by 0 days.

(21) Appl. No.: 10/016,718

(22) Filed: Dec. 10, 2001

(65) Prior Publication Data

US 2002/0069491 A1 Jun. 13, 2002

Related U.S. Application Data

(60) Provisional application No. 60/254,176, filed on Dec. 11, 2000.

(51) Int. Cl.[7] ..... A47G 25/92

(52) U.S. Cl. ..... 24/40; 24/695; 24/41.1; 24/90.1; 2/78.4; 2/115

(58) Field of Search ..... 24/40, 41.1, 42–48, 24/54, 342.1, 372, 90.1, 97, 114.05, 90.5, 102 PL, 563, 695, 114.12; 2/77, 78.4, 100, 112, 115, 128, 251, 252, 257, 263

(56) References Cited

U.S. PATENT DOCUMENTS 441,577 A * 11/1890 McMurray ..... 24/40
719,035 A * 1/1903 Paterson ..... 24/40
956,342 A * 4/1910 Hamburger ..... 24/688
1,108,534 A * 8/1914 Welsh ..... 2/263
1,532,562 A * 4/1925 Vanson ..... 2/127
1,690,694 A * 11/1928 Nissen ..... 24/41.1
2,003,222 A * 5/1935 Rice ..... 24/683
2,086,907 A * 7/1937 Goldschmidt ..... 2/69
2,624,050 A * 1/1953 Boller ..... 2/115
2,740,124 A * 4/1956 Walensky ..... 2/128
4,825,472 A * 5/1989 Garafano ..... 2/116
5,337,457 A * 8/1994 Chennault ..... 24/49 R

* cited by examiner

*Primary Examiner*—J. J. Swann
*Assistant Examiner*—Andre Jackson
(74) *Attorney, Agent, or Firm*—Joseph H. Beumer

(57) ABSTRACT

A device for enhancing the fastening of the top button of a dress shirt comprises a latch member having a tab portion and a hook portion. The tab portion is adapted to be sewn to the button hole placket at the top of the shirt so that the hook portion may engage the top button.

7 Claims, 2 Drawing Sheets

BUTTON LATCH

PRIORITY CLAIM

This application claims benefit of co-pending provisional U.S. Application Serial No. 60/254,176 filed Dec. 11, 2000 entitled "Button Latch"

FIELD OF THE INVENTION

The present invention generally relates to unitary garment accessories. More specifically, the present invention concerns a device utilized to enhance fastening the top button of a shirt in a facile manner. The buttoned shirt presenting a fashionable "dressy" appearance.

BACKGROUND OF THE INVENTION

Advanced age, illness or injury causes many people to lose normal flexibility in their fingers. This lack of flexibility often makes fastening the top button of a dress shirt a difficult if not impossible problem. An uncomplicated device that would provide a simple and inexpensive solution to the aforesaid problem would surely be a welcome addition to the art. Additionally, the device should provide an assembled collar arrangement which is neat in appearance.

The prior art is rife with devices for enhancing the insertion of buttons into buttonholes. For example U.S. Pat. Nos. Des. 27,252 (Hasket), Des. 31,433 (Clarkson) and Des. 33,159 (Yoder) show devices for opening buttonholes prior to insertion of the button. It should be noted that these devices all require a fair amount of manual dexterity.

U.S. Pat. No. 141,484 (Brientnall) discloses a fastening device for the out-of-fashion paper collar.

U.S. Pat. No. 1,074,905 (Smith) and 1,205,663 (Reid) show button devices utilized on collar styles which were fashionable in the decade from 1910–20. The button device of the instant patent could not be used with modern day shirt collars.

A device for holding the ends of a soft collar in place is disclosed in U.S. Pat. No. 1,343,096 (Speyer). The patent does not disclose any structure to aid in fastening a shirt-collar button.

The invention disclosed in U.S. Pat. No. 1,558,370 (Kelly) is drawn to a stud for a banded collar.

U.S. Pat. No. 2,060,643 (Steele) shows a device for holding a buttons and buttonholes in matched relation, but in an unbuttoned or partially buttoned state.

A device used to expand tight collars is disclosed in U.S. Pat. No. 2,983,006 (Schafer). The device appears to require at least the same amount of manipulation as required in a normal collar-buttoning procedure.

U.S. Pat. No. 3,127,651 (Foose et al.) shows a device used to fasten a suit or sport jacket. The size of the patented device would prohibit its use on a shirt collar.

None of the above inventions and patents, taken either singly or in combination, is seen to disclose a button latch for a dress shirt as will subsequently be described and claimed in the instant invention.

SUMMARY OF THE INVENTION

The present invention is drawn to a device to facilitate fastening of the sometimes difficult top button of shirt collars especially collars of dress shirts. As indicated above, the button latch of the instant invention can be advantageously utilized persons with limited manual dexterity to enable such persons quickly and easily fasten (and unfasten) top shirt-collar buttons.

As presently contemplated, the button latch member comprised a unitary structure one end of which is adapted to be sewn to buttonhole placket at the top of the shirt. The other end of the latch member is on attached to the shirt and is fashioned as a hook and is adapted to engage the shirt's top button. The design of the button latch makes fastening and unfastening the top button considerably easier than manipulating the button through the buttonhole, thus requiring much less finger flexibility. A necktie will adequately conceal the button latch.

Accordingly, it is a principal object of the invention that provide a device for facilitating the fastening and unfastening the top button of a dress shirt.

It is a further object to provide such device wherein a first portion of the device is sewn to the shirt and a second portion (having a button hole therein) is unattached from the shirt until the button is inserted in the button hole.

It is another object of the invention to provide a device for facilitating the fastening and unfastening of the top button of dress shirt, which device requires a minimum amount of manual dexterity.

It is a further object of the invention to provide a device for facilitating the fastening and unfastening of the top button of a dress shirt, which device is simplistic in design.

Still another object of the invention is to provide a device for facilitating the fastening and unfastening of the top button of a dress shirt, which device may be easily attached to the dress shirt.

It is an object of the invention to provide improved elements and arrangements thereof in a device for the purposes described which are inexpensive, dependable, and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 2:
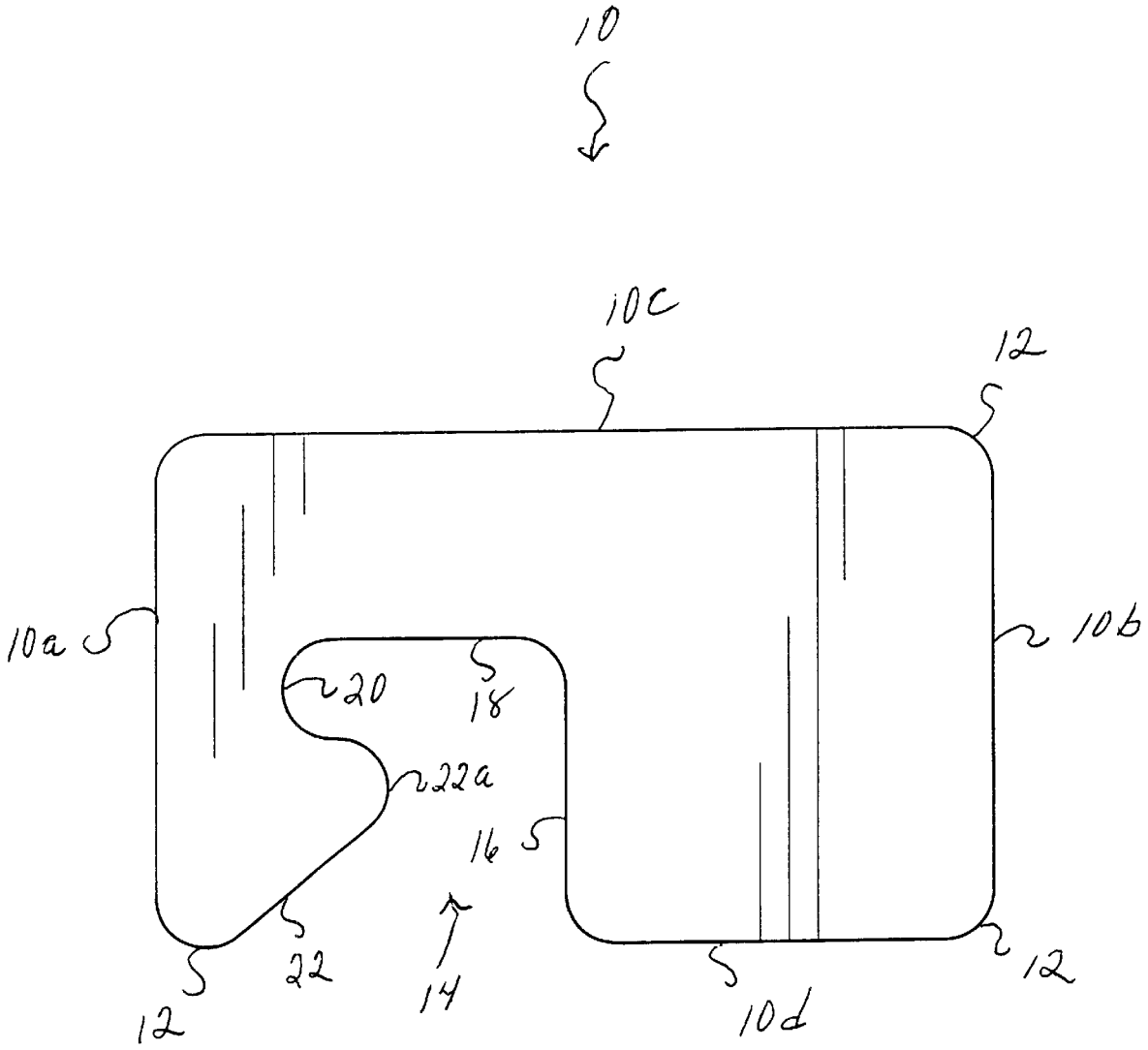
FIG. 2 is a front view of a button latch according to the present invention.

Attention is first directed to FIG. 2 of the drawing wherein the button latch of the present invention is generally indicated at 10. Latch 10 is generally of rectangular configuration having ends 10*a*, 10*b*, top 10*c* and bottom 10*d*. The latch has a height of about 0.62 inches and a width or length of about 1 inch. As presently contemplated, latch 10 is fabricated from a very thin plastic or metal stock. However, it is obvious that other suitable materials may be utilized if desired. The outside corners 12 of the latch are rounded so that no sharp edges are presented. A section of the latch is removed so as to form a hook portion 14. Hook 14 is defined by vertical edge 16, horizontal edge 18, curved edge 20 and slanted edge 22. Slanted edge 22 is rounded at 22*a* for purposes as will be explained below. Vertical edge 16 is horizontally spaced approximately 0.49 inches from end 10*a*. Rounded edge 22*a* is horizontally spaced approximately 0.31 inches from end 10*a*. Curved edge 20 has a radius of curvature of approximately 0.12 inches and is vertically spaced about 0.31 inches from top edge 10*c*.

Figure 1:
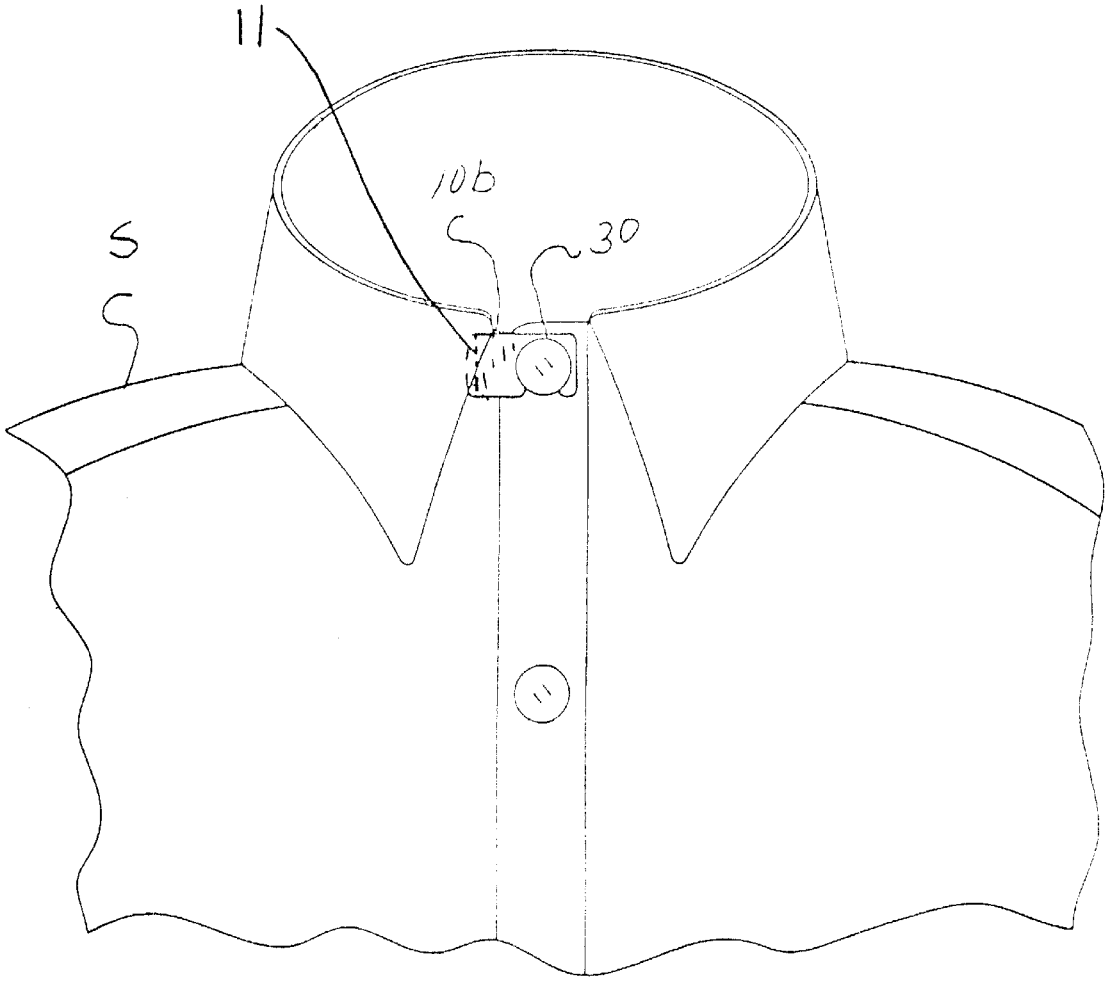
FIG. 1 is an environmental view of a button latch according to the present invention.

Attention is now directed to FIG. 1 wherein the button latch is shown in its contemplated use. End 10*b* is attached to the top buttonhole placket (not shown) of dress shirt S in any convenient manner (sewing, gluing, etc.) at a seam 11 shown in dashed lines. To fasten the top of the shirt, it is merely required that the wearer easily engage the hook portion of the latch with top button 30. Slanted edge 22 and rounded edge 22*a* will create an inclined plane effect to make such engagement even easier. As indicated above, when a necktie (not shown) is donned, the latch will be hidden from view.

It is to be understood that the present invention is not limited to the sole embodiment described above, but encompasses any and all embodiments within the scope of the following claims.

I claim:

1. In combination a dress shirt and a device to facilitate fastening of a top button of the shirt, said shirt comprising a first front panel having a plurality of buttons attached thereto and arranged in vertical alignment and a second front panel provided with buttonholes corresponding said buttons, said shirt further comprising a collar terminated at ends in proximity to said top button and an area of cloth underneath said collar ends;

a thin, rectangular shaped member having a first end and a second end;

a means defining a cut-out portion formed in said rectangular shaped member adjacent said first end, said cut-out portion having a button hole therein;

said means including a vertical oriented edge, a horizontal oriented edge, a curved edge and a slanted edge, said edges defining a guide to said button hole, and means permanently attaching said second end of said member to said second front panel adjacent to a said collar end.

2. A device to facilitate fastening of the top button of a dress shirt, said device comprising:

a thin, rectangular-shaped member having a first end and a second end;

a means defining a cut-out portion formed in said rectangular-shaped member adjacent said first end, said cut-out portion having a button hole therein;

said means including a vertical oriented edge, a horizontal oriented edge, a curved edge and a slanted edge, said edges defining a guide to said button hole; and a means fixedly attaching said second end to said shirt.

3. The device as defined in claim 2 wherein said means fixedly attaching said second end comprises a sewn joint.

4. The device as defined in claim 2 wherein said means fixedly attaching said second end comprises a glued joint.

5. A device as recited in claim 2, including a rounded portion formed on said slanted edge.

6. A device as recited in claim 5, wherein said device is fabricated from a plastic material.

7. A device as recited in claim 5, wherein said device is fabricated from a metallic material.

* * * * *